US008180062B2

(12) United States Patent
Turku et al.

(10) Patent No.: US 8,180,062 B2
(45) Date of Patent: May 15, 2012

(54) SPATIAL SOUND ZOOMING

(75) Inventors: Julia Turku, Espoo (FI); Ole Kirkeby, Espoo (FI); Jarmo Hiipakka, Espoo (FI)

(73) Assignee: Nokia Corporation, Espoo (FI)

( * ) Notice: Subject to any disclaimer, the term of this patent is extended or adjusted under 35 U.S.C. 154(b) by 1266 days.

(21) Appl. No.: 11/755,383

(22) Filed: May 30, 2007

(65) Prior Publication Data

US 2008/0298597 A1 Dec. 4, 2008

(51) Int. Cl.
*H04R 5/00* (2006.01)
*H04R 5/02* (2006.01)

(52) U.S. Cl. ..... 381/27; 381/300

(58) Field of Classification Search ..... 381/310, 381/17, 1, 27; 700/94
See application file for complete search history.

(56) References Cited

U.S. PATENT DOCUMENTS

| | | | | |
|---|---|---|---|---|
| 6,405,163 | B1 | 6/2002 | Laroche | |
| 7,630,500 | B1 * | 12/2009 | Beckman et al. | 381/18 |
| 2003/0007648 | A1 | 1/2003 | Currell | |
| 2004/0013271 | A1 * | 1/2004 | Moorthy | 381/1 |
| 2007/0041592 | A1 | 2/2007 | Avendano et al. | |
| 2007/0286433 | A1 * | 12/2007 | Yoshino | 381/82 |
| 2008/0170718 | A1 * | 7/2008 | Faller | 381/92 |
| 2008/0232601 | A1 * | 9/2008 | Pulkki | 381/1 |
| 2008/0232616 | A1 * | 9/2008 | Pulkki et al. | 381/300 |
| 2009/0279721 | A1 * | 11/2009 | Tanaka | 381/303 |

FOREIGN PATENT DOCUMENTS

| | | | |
|---|---|---|---|
| WO | 2004077884 | A1 | 9/2004 |
| WO | 2006/108543 | A1 | 10/2006 |
| WO | 2007/042108 | A1 | 4/2007 |

OTHER PUBLICATIONS

Julstrom, Stephen, "A High-Performance Surround Sound Process for Home Video," Journal of the Audio Engineering Society, Jul./Aug. 1987, pp. 536-549, vol. 35, No. 7/8, USA.

Gerzon, Michael A., "Optimum Reproduction Matrices for Multispeaker Stereo," Journal of the Audio Engineering Society, Jul./Aug. 1992, pp. 571-589, vol. 40, No. 7/8, USA.

Griesinger, David, "Multichannel Matrix Surround Decoders for Two-Eared Listeners," Audio Engineering Society 101st Convention, Preprint, 1996, pp. 1-22, USA.

Irwan, R. "Two-to-Five Channel Sound Processing," Audio Engineering Society, 2002, pp. 914-926, vol. 50, No. 11, USA.

Li, Yan, "An Unsupervised Adaptive Filtering Approach of 2-to-5 Channel Upmix," Audio Engineering Society, 2005, pp. 1-7, USA.

(Continued)

*Primary Examiner* — Hai Phan
(74) *Attorney, Agent, or Firm* — Banner & Witcoff, Ltd.

(57) ABSTRACT

Aspects of the invention provide methods, computer-readable media, and apparatuses for digital processing of acoustic signals to create a reproduction of a natural or an artificial spatial sound environment. An aspect of the invention supports spatial audio processing such as extracting a center channel in up-mixing stereo sound for multi-channel loudspeaker setup or headphone virtualization. An aspect of the invention also supports directional listening in which sound sources in a desired direction may be amplified or attenuated. Direction and diffuseness parameters for regions of input channels are determined and an extracted channel is extracted from the input channels according to the direction and diffuseness parameters. A gain estimate is estimated for each signal component being fed into the extracted channel and an extracted channel may be synthesized from a base signal and the gain estimate. The input channels may be partitioned into a plurality of time-frequency regions.

21 Claims, 5 Drawing Sheets

OTHER PUBLICATIONS

Avendano, Carlos, "Frequency-Domain Techniques for Stereo to Multichannel Upmix," Audio Engineering Society, International Conference on Virtual, Synthetic and Entertainment Audio, 2002, pp. 1-10, Finland.
Jot, Jean-Marc, "Spatial Enhancement of Audio Recordings," AES 23rd International Conference, 2003, pp. 1-11, Denmark.
Elen, R. "Ambisonic.net" <http://www.ambisonic.net/>, 1998, pp. 1-27, USA.
University of York, "Sound in Space," Music Technology Group, 2004, pp. 1-2, England.
Malham D. G., "Spatial Hearing Mechanisms and Sound Reproduction," University of York, Music Technology Group 1998, pp. 1-12, England.
Merimaa, Juha, "Spatial Impulse Response Rendering I: Analysis and Synthesis," Audio Engineering Society, 2005, vol. 53, No. 12, pp. 1115-1127, USA.
Pulkki, Ville, "Spatial Impulse Response Rendering II: Repoduction of Diffuse Sound and Listening Tests," Audio Engineering Sociey, 2006, vol. 54, No. 1/2, pp. 3-18, USA.
Pulkki, Ville, "Spatial Impulse Response Rendering: Listening Tests and Applications to Continuous Sound," Audio Engineering Society, 2005, pp. 1-13, Spain.

* cited by examiner

SPATIAL SOUND ZOOMING

FIELD OF THE INVENTION

The present invention relates to processing acoustical signals for creating a spatial sound environment. In particular, the invention supports directional acoustical channels.

BACKGROUND OF THE INVENTION

There are currently several techniques for center channel extraction, typically based on summing the stereo channel signals, feeding the center channel with that signal, and subtracting something derived from that signal from the stereo signals. However, when utilizing loudspeakers, these approaches often have difficulty in achieving stable audio image for listeners located away from the sweet spot, as well as preserving the width of the stereo image.

One approach to generate a center channel from stereo channels using the following passive 2-to-3 channel up-mix matrix:

$$\begin{pmatrix} L' \\ C' \\ R' \end{pmatrix} = \begin{pmatrix} 1 & 0 \\ 0.707 & 0.707 \\ 0 & 1 \end{pmatrix} \begin{pmatrix} L \\ R \end{pmatrix}, \quad \text{(EQ. 1)}$$

where the factor 0.707 has the effect of equalizing the energy of the three channels when L and R are uncorrelated and of equal energy. However, with this approach the sound image may be narrowed by approximately 25% while the center-panned sound sources may be boosted by 1.25 dB relative to sources panned to the sides. The up-mix matrix may be generalized into a class of energy preserving N-to-M up-mix decoders, which allows the width of the audio image to be controlled. However, the left and right loudspeakers may be required to be re-positioned more widely when the center loudspeaker is added, which is typically not practical. Furthermore, the perceived localization of the sound sources may be significantly altered for listeners outside the sweet spot.

Another approach is to use an active up-mix matrix (or matrix steering) to improve the signal separation by introducing signal-dependent matrix coefficients. This approach may use principal component analysis to identify the dominant signal component and its panning position. The fundamental limitation of this approach is typically the inability of tracking multiple dominant sources simultaneously. This limitation may cause an instability in the audio image. This approach may be extended by introducing sub-band processing, which enables detecting one dominant signal component in each frequency band. However, listening tests often reveal audible artifacts due to parameter adaptation inaccuracies, as well as degradation of performance in connection with delay panning.

Another typical objective with the center channel extraction is the removal of the singer's voice from a recording, useful for applications such as karaoke. A frequency-domain center-panned source separation method may be used, however, with a lack of generality. For example, there is no general description of how to generate a center channel signal compatible to the created stereo signal.

With another approach, center channel extraction is obtained by dividing a stereo signal into time-frequency plane components and applying a left-right similarity measure for deriving a panning index for the dominant source of each component. A similarity measure $\phi(m,k)$ is computed as $$\varphi(m, k) = \frac{2X_L(m, k)X_R^*(m, k)}{|X_L(m, k)|^2 + |X_R(m, k)|^2}, \quad \text{(EQ. 2)}$$

where $X_L(m, k)$ and $X_R(m, k)$ denote the short-time Fourier transforms of the stereo signal.

The center channel signal is extracted by selecting the time-frequency components that correspond to a similarity measure of 1 (maximum) and synthesizing a signal by inverse STFT. This signal is subtracted from the original stereo channels so that the three-channel presentation remains spatially undistinguishable from the two-channel presentation for a listener located at the sweet spot. This approach often has a disadvantage in that the approach does not take into account inter-channel time differences, and is thus limited to recordings using amplitude panning or coincident microphone techniques.

BRIEF SUMMARY OF THE INVENTION

An aspect of the present invention provides methods, computer-readable media, and apparatuses for digital processing of acoustic signals to create a reproduction of a natural or an artificial spatial sound environment. The invention supports spatial audio processing such as extracting a center channel in up-mixing stereo sound for multi-channel loudspeaker setup or headphone virtualization. The invention also supports directional listening in which sound sources in a desired direction may be amplified or attenuated.

With another aspect of the invention, direction and diffuseness parameters for time-frequency regions of input channels are determined and an extracted channel is extracted from the input channels according to the direction and diffuseness parameters, where the extracted channel corresponds to a desired direction. The input signals may include a left input channel and a right input channel, and the extracted channel corresponds to a center channel along a median axis.

With another aspect of the invention, an input signal may have a B-format or may be transformed into a B-format signal.

With another aspect of the invention, a gain estimate is estimated for each signal component being fed into the extracted channel. An extracted channel may be synthesized from a base signal and the gain estimate. The gain estimate may be further smoothed over a time duration. The input channels may be partitioned into a plurality of time-frequency regions.

With another aspect of the invention, characteristics of an extracted channel may be externally controlled, including a selected desired direction.

With another aspect of the invention, extracted channels may be re-mixed to form a spatially enhanced channel.

BRIEF DESCRIPTION OF THE DRAWINGS

A more complete understanding of the present invention and the advantages thereof may be acquired by referring to the following description in consideration of the accompanying drawings, in which like reference numbers indicate like features and wherein.

DETAILED DESCRIPTION OF THE INVENTION

In the following description of the various embodiments, reference is made to the accompanying drawings which form a part hereof, and in which is shown by way of illustration various embodiments in which the invention may be practiced. It is to be understood that other embodiments may be utilized and structural and functional modifications may be made without departing from the scope of the present invention.

As will be further discussed, embodiments of the invention may support the extraction of a directional channel from stereo audio. Extracted directional channels may be utilized in producing modified spatial audio. For example, when an application is introduced in which the level of each channel may be individually modified, the extracted channels may be re-mixed for playback over an arbitrary loudspeaker (including headphones) setup. In addition, the selection of the direction in which the sound sources are extracted into a separate channel may be controlled externally.

As will be further discussed, embodiments of the invention support a signal format that is agnostic to the transducer system used in reproduction. Consequently, a processed signal may be played through headphones and different loudspeaker setups.

Figure 1:
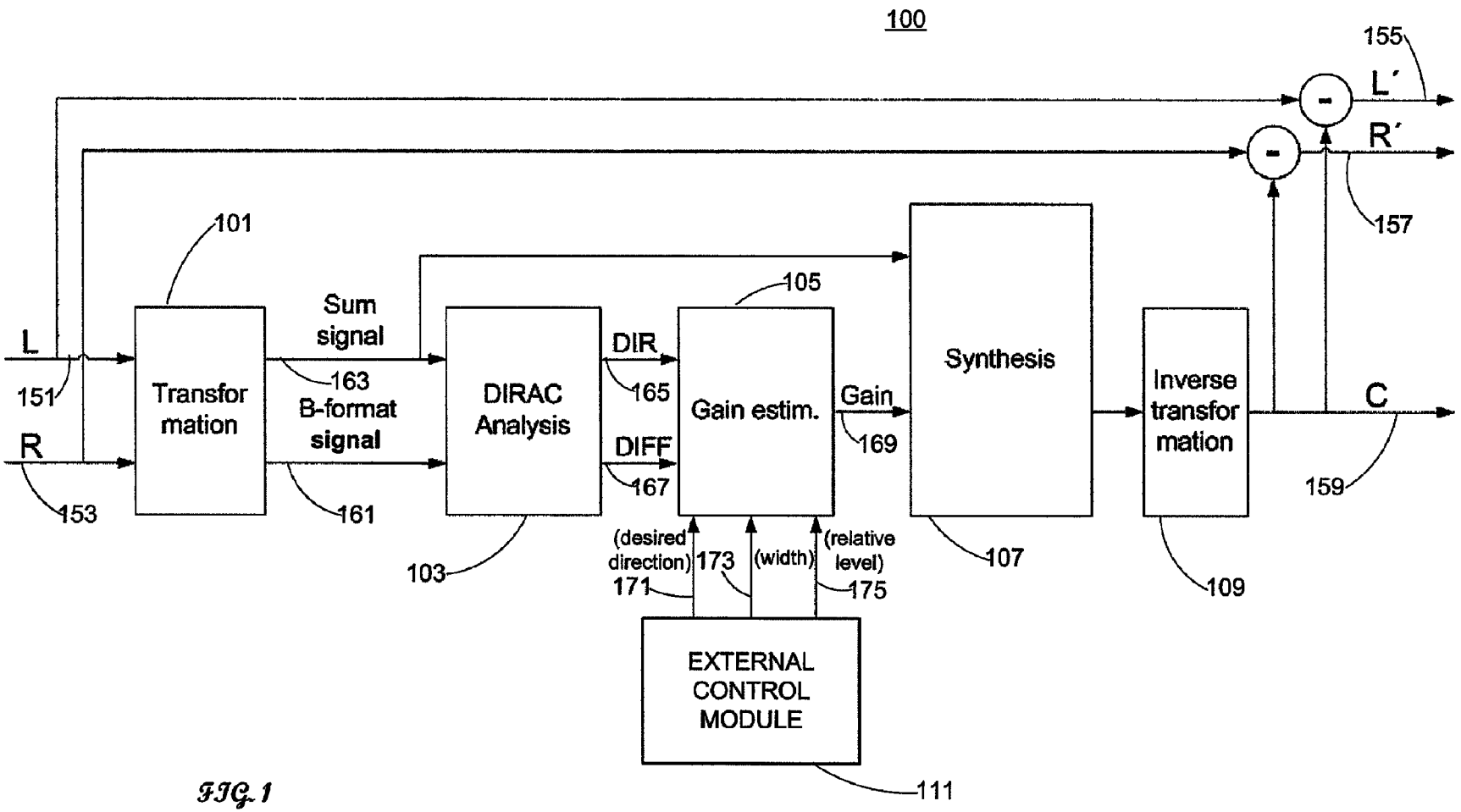
FIG. 1 shows an architecture for directional channel extraction according to an embodiment of the invention.

FIG. 1 shows an architecture 100 for directional channel extraction according to an embodiment of the invention. Architecture 100 supports digital processing of sound for creating the reproduction of a natural or an artificial spatial sound environment. Architecture 100 may be utilized in spatial audio processing for up-mixing stereo sound for multichannel loudspeaker setup or headphone virtualization.

Architecture 100 obtains extracted channel 159 in the frequency domain. (Note that depending on different processing choices, computation of various parameters or transformation steps can be circumvented.) Also, various mappings, quantizations or transformations can be used in simplifying or modifying the method. As shown in FIG. 1, DIR parameter 165 denotes the direction of arrival estimate, DIFF parameter 167 denotes the diffusion estimate, and gain parameter 169 refers to the gain at which each signal component is fed into extracted channel 159.

Direct audio channel (DirAC) analysis module 103 is fed with B-format signal 161 from transformation module 101. A signal (e.g., a stereo signal comprising input left channel signal 151 and input right channel signal 153) may be obtained in B-format (as signal 161) either by recording it with a suitable microphone setup or by converting it from another format.

DirAC analysis module 103 extracts center channel signal 159 from stereo signals 151 and 153 (in general from any two audio channels). DirAC analysis module 103 provides time and frequency dependent information on the directions of sound sources as well as on the relative portions of direct and diffuse sound energy. Direction and diffuseness information are used in selecting the sound sources positioned near or on the median axis between the two loudspeakers and in directing the sound sources into center channel 159. Modified stereo signals 155 and 157 are generated by subtracting the direct sound portion of those sound sources from input stereo signals 151 and 153, thus preserving the correct directions of arrival of the echoes.

With embodiments of the invention, extracting center channel 159 from the input (original) stereo signals 151-153 in a reproduction system may improve the spatial resolution as well as increasing the size of the sweet spot, in which the listeners receive the accurate spatial audio image. (The sweet spot is typically defined as the listening location from which the best soundstage presentation is heard. Usually, the sweet spot is a center location equidistant from the loudspeakers.) Moreover, isolating voice sources and directing them only to the center channel may improve sound quality compared to plain amplitude panning techniques.

The information of source directions provided by DirAC analysis module 103 can be further utilized in extracting the sound sources in any desired direction instead of those in the center, and playing them back over separate channels. Furthermore, the levels of the individual channels can be modified, and a re-mix can be created. This scenario enables directional listening, or auditory "zooming", where the listener can "boost" sounds coming from a chosen direction, or alternatively suppress them. An extreme case is the spatialization of monophonic playback, where the sound sources in the direction of interest are boosted relative to the overall auditory scene.

To record a B-format signal 161, the desired sound field is represented by its spherical harmonic components in a single point. The sound field is then regenerated using any suitable number of loudspeakers or a pair of headphones. With a first-order implementation, the sound field is described using the zeroth-order component (sound pressure signal W) and three first-order components (pressure gradient signals X, Y, and Z along the three Cartesian coordinate axes). Embodiments of the invention may also determine higher-order components.

The first-order signal that consists of the four channels W, X, Y, and Z, often referred as the B-format signal. One typically obtains a B-format signal by recording the sound field using a special microphone setup that directly or through a transformation yields the desired signal.

Besides recording a signal in the B-format, it is possible to synthesize the B-format signal. For encoding a monophonic audio signal into the B-format in the time-domain, the following coding equations are used:

$$\begin{aligned} W(t) &= \frac{1}{\sqrt{2}}x(t) \quad , \\ X(t) &= \cos\theta\cos\varphi x(t) \\ Y(t) &= \sin\theta\cos\varphi x(t) \\ Z(t) &= \sin\varphi x(t) \end{aligned} \qquad \text{(EQ. 3)}$$

where x(t) is the monophonic input signal, θ is the azimuth angle (anti-clockwise angle from center front), ϕ is the elevation angle, and W(t), X(t), Y(t), and Z(t) are the individual channels of the resulting B-format signal. Note that the multiplier on the W signal is a convention that originates from the need to get a more even level distribution between the four channels. (Some references use an approximate value of 0.707 instead.) It is also worth noting that the directional angles can, naturally, be made to change with time, even if this was not explicitly made visible in the equations. Multiple monophonic sources can also be encoded using the same equations individually for all sources and mixing (adding together) the resulting B-format signals. Note also that the conversion can be done in frequency-domain with corresponding equations.

If the format of the input signal is known beforehand, the B-format conversion can be replaced with simplified computation. For example, if the signal can be assumed the standard 2-channel stereo (with loudspeakers at ±/30 degrees angles), the conversion equations reduce into multiplications with constants. Currently, this assumption holds for many application scenarios.

DirAC analysis module 103 may process B-format signal 161 either in the frequency domain, namely in DFT-domain, or in various sub-band domains, for example, with quadrature mirror filters (QMF) or with some other filter-bank domain. Processing by analysis module 103 is discussed in more detail with FIGS. 2 and 3. Basically, the signal is divided both time- and frequency-wise into regions of suitable (for example perceptually motivated) size. Thus, both the width of the frequency band as well as the length of the time window may vary at different frequencies. DirAC analysis module 103 determines two parameters 165 and 167 for each time-frequency region: the direction of arrival (direction parameter 165 and in the case of a stereo signal, an azimuth angle value) of the dominating sound source in each time-frequency region and the relative amount of diffuse sound energy (diffuseness parameter 167), i.e., sound that has no direction of arrival, in each time-frequency region. In the DirAC analysis, the directional analysis is based on an energetic analysis of sound field. The instantaneous velocity vector is composed as $\bar{v}(k,n)=x(k,n)\bar{e}_x+y(k,n)\bar{e}_y+z(k,n)\bar{e}_z$, where $e_x$, $e_y$, and $e_z$ represent Cartesian unit vectors, and x, y and z are the B-format directional signals within the time-frequency region (k,n). The instantaneous intensity I is computed as $\bar{I}(k,n)=w(k,n)\bar{v}(k,n)$, where w refers to the B-format omnidirectional signal. The direction parameter can be derived from the instantaneous intensity as $\overline{DIR}(k,n)=-\bar{I}(k,n)$. The instantaneous energy is $E(k,n)=w^2(k,n)+\|\bar{v}\|^2(k,n)$, where $\|\bullet\|$ denotes vector norm. The diffuseness parameter is computed as $$DIFF(k,n)=1-\frac{\|\bar{I}(k,n)\|}{E(k,n)}.$$

Parameters 165 and 167 are then utilized in extracting center channel 159.

Direction parameter 165 (which comprises the azimuth value for stereo signals 151 and 153) is converted into gain parameter 169 which defines the amount of sound energy directed into the center channel 159. Choosing a windowed or weighted angle of directions over a single direction value may result in less perceivable artifacts.

Estimation module 105 determines gain parameters 169 from direction and diffuseness parameters 165 and 167. The gain parameter can be derived from the direction parameter essentially by mapping, by setting it to 1 for time-frequency regions where the value of parameter DIR corresponds to the desired direction of extraction and to 0 everywhere else. Better sound quality may be obtained by applying a window function, e.g., a Hanning-window or a step-wise linear function, in place of the step function. Gain parameters 169 are then smoothed at least time-wise, in which each gain parameter corresponds to a time-frequency region. The need for frequency-wise smoothing, as well as the method and parameters for time-wise smoothing, depend on the overall processing.

One often uses low-pass filtering to smooth in the time.

With embodiments of the invention in the time domain, DirAC analysis module 103 and estimation module 105 may be circumvented by calculating the gain directly from the input signals 151 and 153. The gain is given by $$g=1-\frac{\left|\sqrt{d}\,L-\sqrt{1-d}\,R\right|}{\left|\sqrt{d}\,L\right|+\left|\sqrt{1-d}\,R\right|+\varepsilon}, \quad \text{(EQ. 4)}$$

where g refers to the gain, |X| corresponds to the short-term energy of a signal denoted as X, and ϵ is a small positive number included to avoid numerical problems when both L and R are close to zero. The parameter d, used in controlling the direction of extraction, is defined as $$d=\frac{1+\frac{\sigma}{|\sigma|}\left(\frac{\sin(\sigma)}{\sin(\sigma_0)}\right)^2}{2},$$

where σ refers to the desired direction of extraction and $\sigma_0$ is the loudspeaker angle from the center axis. The parameter d can be derived from the stereophonic law of sines. In the special case of extracting the center channel, the parameter σ is 0 and the gain equation is reduced to $$g=1-\frac{|L-R|}{|L|+|R|+\varepsilon}.$$

Synthesizer 107 creates center channel 159 by processing sum signal 163 of input stereo channels 151 and 153 (in B-format, the W signal) as the base signal. Gain parameters 169 are applied to the direct sound portion of sum signal 163, that is, the portion of sound arriving directly from a sound source. For a frequency-domain signal x(k,n), $k^{th}$ frequency band, $n^{th}$ time window, this portion can be extracted by applying the equation $X(k,n)_{DIR}=[1-DIFF(k,n)]x(k,n)$, where $x(k,n)_{DIR}$ refers to the direct sound portion, and DIFF is the diffuseness parameter 167 defined as $0 \leqq DIFF \leqq 1$ for corresponding time-frequency regions. Thus, the derivation of the extracted signal becomes C=[1−DIFF]gW, where C is the extracted channel 159. Consequently, only the direct sound is extracted so that stereo channels preserve their original diffuseness. However, with time domain processing, the extraction of direct sound portion may be included in the gain calculation. Modified stereo channels 155 and 157 are obtained by subtracting extracted channel 159 from them. Synthesizer 107 insures that the sound energy spectrum of the three-channel signals 155, 157, and 159 remains equal to that of the original stereo signals 151 and 153. Also, synthesizer 107 insures that the signals to be subtracted are synchronized relative to each other. The subtraction can be done in any processing domain.

After extraction, the extracted channel is inverse transformed into time-domain by module 109. This is obviously unnecessary if the processing is performed in the time-domain, or if the output signals are required in transform domain. Alternatively, the subtraction can be performed prior to synthesis, in which case 3 channels are inverse transformed.

Architecture 100 enables a sound field to be represented in a format compatible with any arbitrary loudspeaker (or transducer, in general) setup in reproduction. This is due to the fact that the sound field is coded in parameters that are fully independent of the actual positions of the setup used for reproduction, namely direction of arrival angles (azimuth, elevation) and diffuseness.

In order to further reduce the computational complexity, the processing can be applied to a limited portion of the entire frequency spectrum by processing only a part (proper subset) of the frequency bands (e.g., as performed by QMF processing). For the frequency component not contained in the processed portion, the remaining signal component may be directed to center channel 159 or to modified stereo channels 155 and 157, depending on the application.

However, embodiments of the invention are not limited to extracting channels in the center direction. Information of source directions provided by DirAC analysis module 103 may be further utilized in extracting the sound sources in any desired direction and playing the processed signal back over separate channels. Center channel extraction corresponds to a special case of the directional channel extraction. The desired azimuth can be chosen as in the middle of the stereo loudspeaker directions (median axis), which further simplifies processing by modules 103, 105, and 107.

Directional listening or sound zooming refers to performing the amplification (or attenuation) of the sound sources in a desired direction or directions in an auditory scene.

Furthermore, sound sources may be extracted in other directions besides the center direction (i.e. the median axis between two loudspeakers), enabling directional listening by amplifying sound sources in a desired direction. Sound zooming may even allow reproducing spatial audio over a single loudspeaker by providing means to control the direction of zooming.

The zooming direction may be steered through external control module 111 with a single parameter (corresponding to desired direction parameter 171). In addition, the width of the directional cone or region may be controlled with another parameter (corresponding to width parameter 173). This allows dynamic real-time control of the zooming. Also, the mode and level modification (corresponding to level parameter 175) can be steered externally. Consequently, parameters 171-175 can be used in visualizing the audio scene and the processing.

Figure 2:
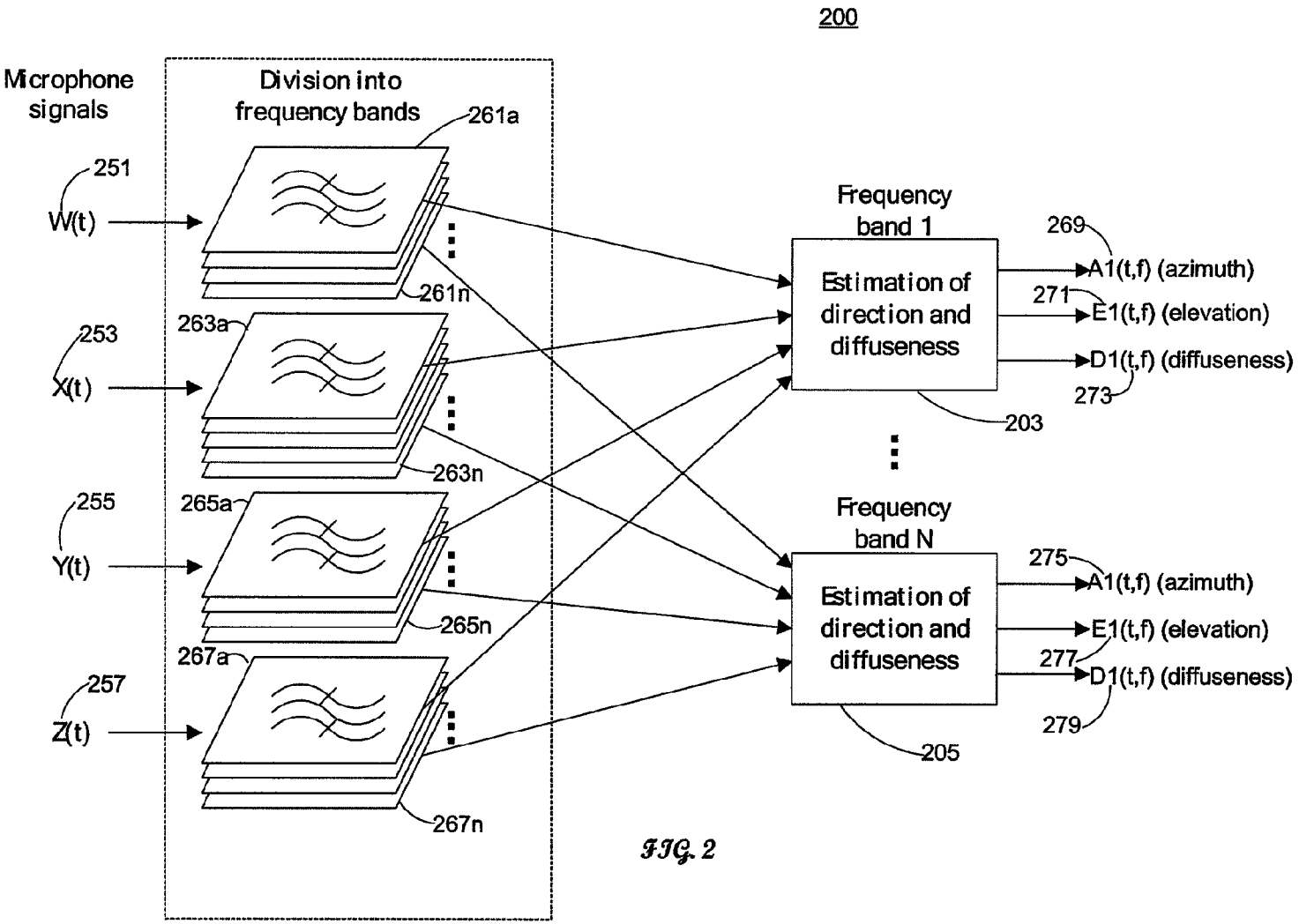
FIG. 2 shows an architecture for directional audio coding (DirAC) analysis according to an embodiment of the invention.

FIG. 2 shows an architecture 200 for a directional audio coding (DirAC) analysis module (e.g., module 103 as shown in FIG. 1) according to an embodiment of the invention. With embodiments of the invention, DirAC analysis extracts the center channel signal from a stereo signal (in general from any two audio channels). DirAC analysis provides time and frequency dependent information on the directions of sound sources regarding the listener and the relation of diffuseness to direct sound energy. This information is then used in selecting the sound sources positioned near or on the median axis between the two loudspeakers and directing them into the center channel. The signal for the stereo loudspeakers may be generated by subtracting the direct sound portion of those sound sources from the original stereo signal, thus preserving the correct directions of arrival of the echoes.

DirAC analysis module 103 analyzes the output from a spatial microphone system. As shown in FIG. 2, a B-format signal comprises components W(t) 251, X(t) 253, Y(t) 255, and Z(t) 257. Using a short-time Fourier transform (STFT), each component is transformed into frequency bands 261*a*-261*n* (corresponding to W(t) 251), 263*a*-263*n* (corresponding to X(t) 253), 265*a*-265*n* (corresponding to Y(t) 255), and 267*a*-267*n* (corresponding to Z(t) 257). Direction-of-arrival parameters (including azimuth and elevation) and diffuseness parameters are estimated for each frequency band 203 and 205 for each time instance. As shown in FIG. 2, parameters 269-273 correspond to the first frequency band, and parameters 275-279 correspond to the $N^{th}$ frequency band.

Figure 3:
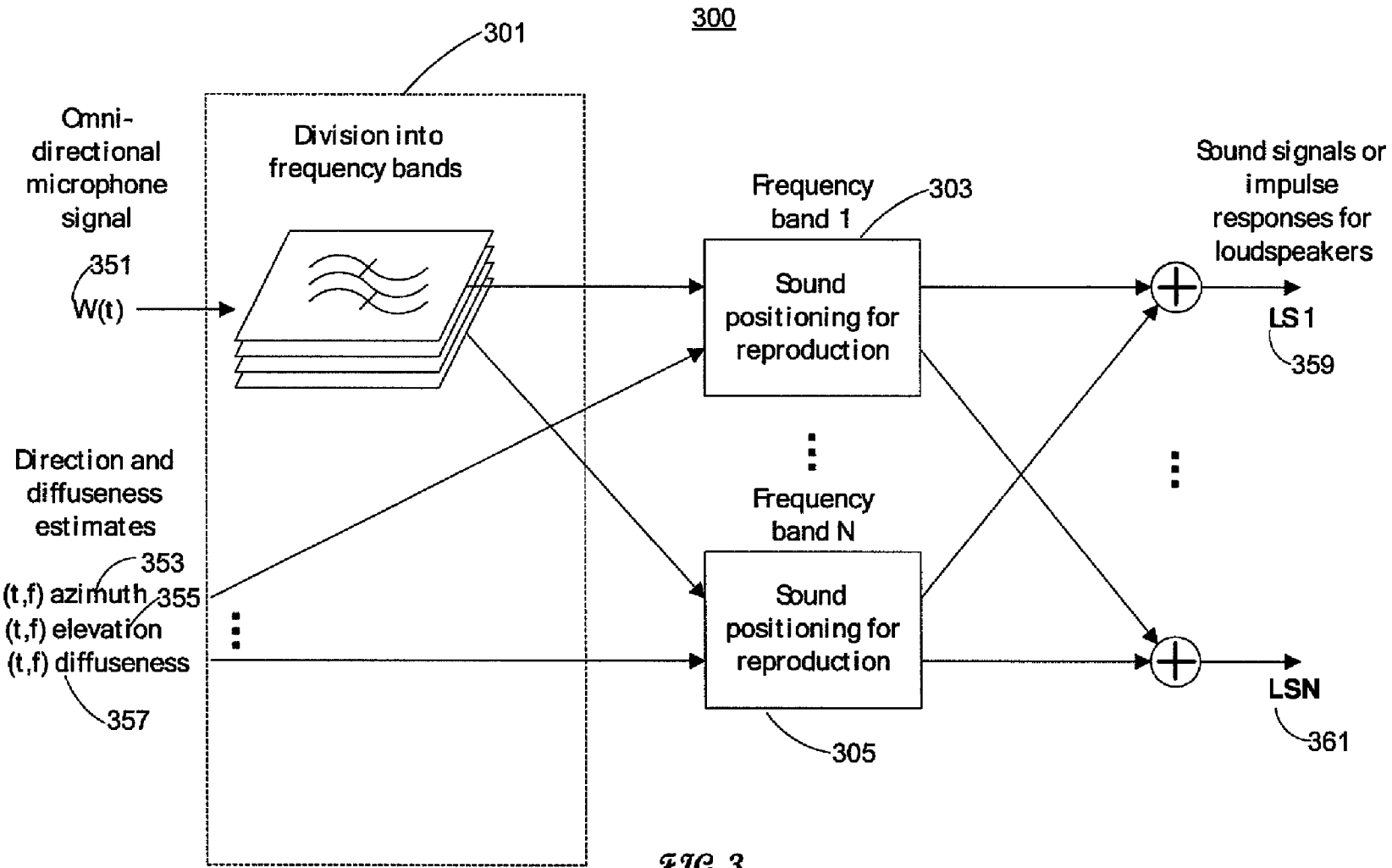
FIG. 3 shows an architecture for directional audio coding (DirAC) synthesis according to an embodiment of the invention.

FIG. 3 shows an architecture 300 for a directional audio coding (DirAC) synthesizer (e.g., module 107 as shown in FIG. 1) according to an embodiment of the invention. Base signal W(t) is divided into a plurality of frequency bands by transformation process 301. Synthesis is based on processing the frequency components of base signal W(t) 351. W(t) 351 is typically recorded by the omni-directional microphone. The frequency components of W(t) 351 are distributed and processed by sound positioning and reproduction processes 305-307 according to the direction and diffuseness estimates 353-357 gathered in the analysis phase to provided extracted signals to loudspeakers 359 and 361.

Figure 4:
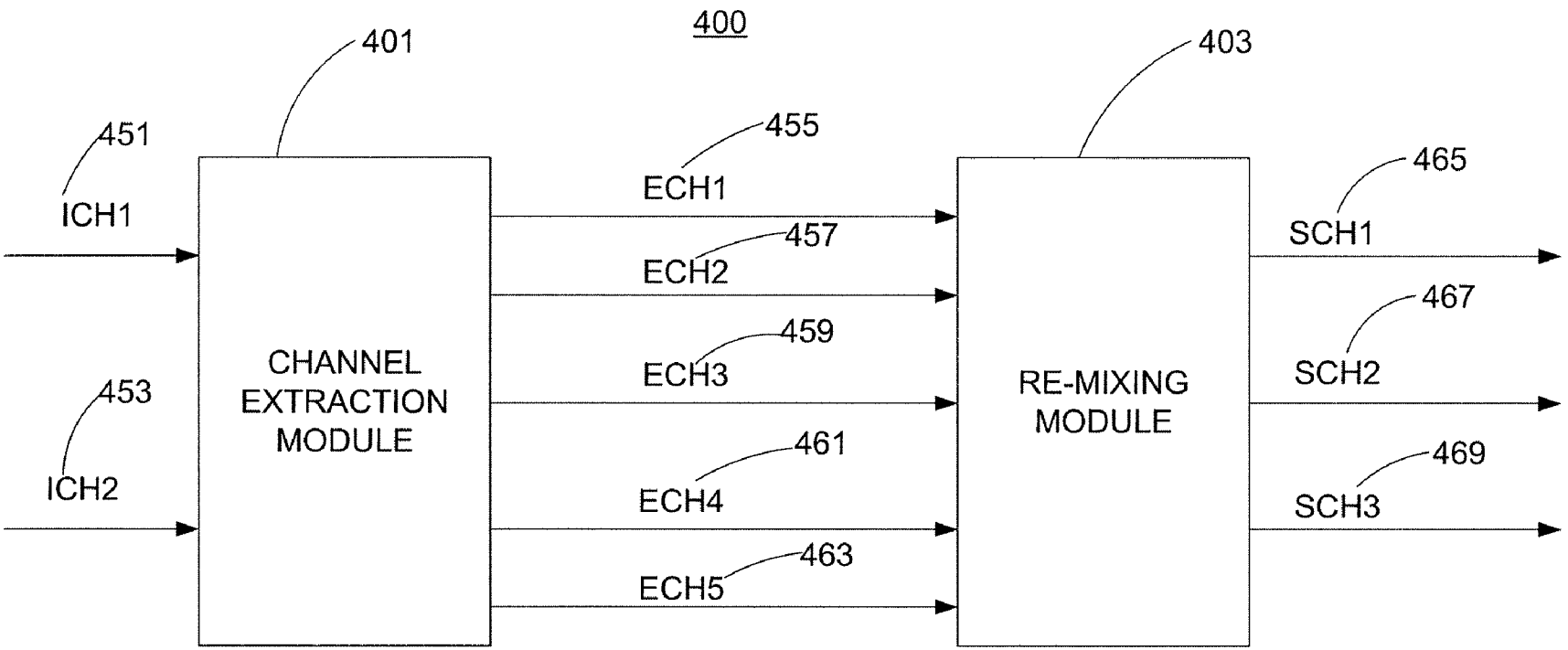
FIG. 4 shows an apparatus extracting directional channels from input signals and re-mixing the extracted channels into spatially enhanced channels according to an embodiment of the invention.

FIG. 4 shows apparatus 400 extracting directional channels 455-463 from input signals 451-453 and re-mixing extracted channels 455-463 into spatially enhanced channels 465-469 according to an embodiment of the invention. As previously discussed, channel extraction module 401 obtains extracted channels 455-463 from input channels 455-463.

Re-mixing module 403 re-mixes extracted channels 455-463 (e.g., by sunning) to new channels 465-469 for stereo and monophonic playback. Monophonic playback allows reproducing spatial audio over a single loudspeaker. Furthermore, the levels of the individual channels may be modified and may be re-mixed into a reduced number of channels.

Also, reproduction of stereo audio for headphone listening may be spatially enhanced by extracting the center channel signal. Segregated loudspeaker signals may be virtualized over headphones and manipulated separately. For example, various reverberation and other enhancement methods may be applied to the center (or some other) direction separately, while maintaining the proper balance between left and right.

Furthermore, with embodiments of the invention a spatially enhanced sound scene can be created by re-mixing the new channels together, and thus spatially enhanced audio channels 465-469 can be dynamically created for a modest number of loudspeakers (in some cases even one).

Figure 5:
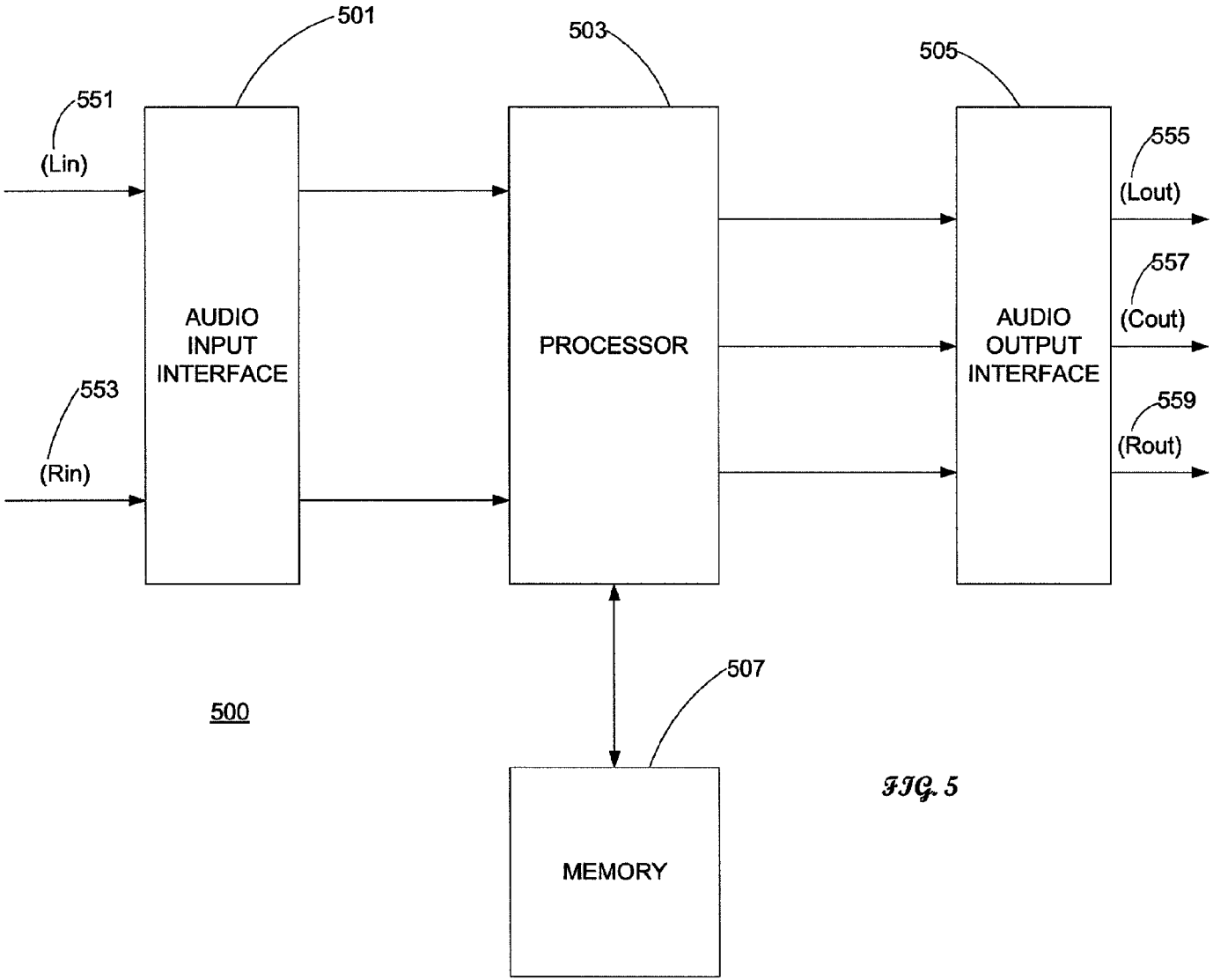
FIG. 5 shows an apparatus for extracting directional channels from acoustic signals according to an embodiment of the invention.

FIG. 5 shows apparatus 500 for extracting directional channel 557 from acoustic input signals 551-553 according to an embodiment of the invention. Processor 503 obtains left channel stereo signal 551 and right channel stereo signal 553 through audio input interface 501. With embodiments of the invention, signals 551-553 may be recorded in a B-format or audio input interface may convert signals 551-553 in a B-format using EQ. 3. Modules 103, 105, and 107 may be implemented by processor 503 executing computer-executable instructions that are stored on memory 507. Modified stereo channels 555 and 559 may be generated by subtracting the direct sound portion of those sound sources from input stereo signals 551 and 553, thus preserving the correct directions of arrival of the echoes.

Apparatus 500 may assume different forms, including discrete logic circuitry, a microprocessor system, or an integrated circuit such as an application specific integrated circuit (ASIC).

As can be appreciated by one skilled in the art, a computer system with an associated computer-readable medium containing instructions for controlling the computer system can be utilized to implement the exemplary embodiments that are disclosed herein. The computer system may include at least one computer such as a microprocessor, digital signal processor, and associated peripheral electronic circuitry.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. A method comprising:

receiving at least two input audio channels having a plurality of direction parameters for regions of the at least two input audio channels;

receiving a direction of sound to extract from the at least two input audio channels;

determining an output angle of a loudspeaker measured from a median axis of a listening direction; and extracting, with a circuit, an extracted audio channel for output on the loudspeaker from the at least two input audio channels according to the direction parameters, the extracted audio channel corresponding to the direction of sound to extract, wherein the extracted audio channel includes portions of one or more of the plurality of direction parameters, and wherein each portion is determined based on the direction of sound to extract and the output angle of the loudspeaker.

2. The method of claim 1, wherein the at least two input audio channels comprise a left input channel and a right input channel.

3. The method of claim 1, further comprising:

determining a gain value for the extracted audio channel, wherein the at least two input channels comprise a left input channel and a right input channel, and wherein the gain value includes a gain (g) determined by:

$$g = 1 - \frac{\left|\sqrt{d}\,L - \sqrt{1-d}\,R\right|}{\left|\sqrt{d}\,L\right| + \left|\sqrt{1-d}\,R\right| + \varepsilon}$$

where $$d = \frac{1 + \frac{\sigma}{|\sigma|}\left(\frac{\sin(\sigma)}{\sin(\sigma_0)}\right)^2}{2},$$

$\sigma$ is the direction of sound to extract, $\sigma_0$ is the output angle of a loudspeaker, L is the left input channel, R is the right input channel, and $\epsilon$ is a small positive number included to avoid numerical problems when both L and R are approximately zero.

4. The method of claim 1, further comprising:

determining a gain value for the extracted audio channel, and smoothing the gain value over a time duration.

5. The method of claim 1, further comprising:

externally controlling a characteristic of the extracted audio channel by dynamically varying the direction of sound to extract.

6. The method of claim 1, further comprising:

receiving a second direction of sound to extract from the at least two input audio channels; and extracting a second extracted audio channel from the at least two input audio channels, the second extracted audio channel including second portions of one or more of the plurality of direction parameters, wherein each second portion is determined based on the second direction of sound to extract and the output angle of the loudspeaker.

7. The method of claim 2, wherein the extracted audio channel corresponds to a center channel along the median axis of a listening direction, the method further comprising:

applying the extracted audio channel to signals that are provided to a stereo headphone.

8. The method of claim 2, further comprising:

subtracting the extracted audio channel from the left and right input channels to generate left and right audio output signals, respectively.

9. The method of claim 6, further comprising:

re-mixing the extracted audio channel and second extracted audio channel into a single spatially enhanced channel; and applying the single spatially enhanced channel to the loudspeaker.

10. The method of claim 1, wherein each of the at least two input audio channels includes direction parameters indicating audio from multiple different directions.

11. An apparatus comprising:

a processor and memory storing machine executable instructions that when executed by the processor, cause the apparatus to:

receive at least two input audio channels having a plurality of direction parameters for regions of the at least two input audio channels;

receive a direction of sound to extract from the at least two input audio channels;

determine an output angle of a loudspeaker measured from a median axis of a listening direction; and extract an extracted audio channel for output on the loudspeaker from the at least two input audio channels according to the direction parameters, the extracted audio channel corresponding to the direction of sound to extract, wherein the extracted audio channel includes portions of one or more of the plurality of direction parameters, and wherein each portion is determined based on the direction of sound to extract and the output angle of the loudspeaker.

12. The apparatus of claim 11, further comprising:

an external control module configured to control a characteristic of the extracted audio channel by dynamically varying the direction of sound to extract.

13. The apparatus of claim 11, wherein the instructions, when executed by the processor, further cause the apparatus to:

receive a second direction of sound to extract from the at least two input audio channels;

extract a second extracted audio channel from the at least two input audio channels, the second extracted audio channel including second portions of one or more of the plurality of direction parameters, and wherein each second portion is determined based on the second direction of sound to extract and the output angle of the loudspeaker; and remix the extracted audio channel and second extracted audio channel into at least one spatially enhanced channel.

14. The apparatus of claim 11, wherein each of the at least two input audio channels includes direction parameters indicating audio from multiple different directions.

15. The apparatus of claim 11, wherein the at least two input audio channels comprise a left input channel and a right input channel.

16. The apparatus of claim 15, wherein the machine executable instructions, when executed by the processor, further cause the apparatus to:

generate a left output stereo channel and a right output stereo channel by subtracting the extracted audio channel from the left input channel and right input channel, respectively.

17. A non-transitory computer-readable medium having computer-executable instructions that when executed by a processor, cause an apparatus to:

receive at least two input audio channels having a plurality of direction parameters for regions of the at least two input audio channels;

receive a direction of sound to extract from the at least two input audio channels;

determine an output angle of a loudspeaker measured from a median axis of a listening direction; and extract an extracted audio channel for output on the loudspeaker from the at least two input audio channels according to the direction parameters, the extracted audio channel corresponding to the direction of sound to extract, wherein the extracted audio channel includes portions of one or more of the plurality of direction parameters, and wherein each portion is determined based on the direction of sound to extract and the output angle of the loudspeaker.

18. The non-transitory computer-readable medium of claim 17, wherein the instructions, when executed, further cause the apparatus to perform:

externally controlling a characteristic of the extracted audio channel by dynamically varying the direction of sound to extract.

19. The non-transitory computer-readable medium of claim 17, wherein the instructions, when executed, further cause the apparatus to:

receive a second direction of sound to extract from the at least two input audio channels; and extract a second extracted audio channel from the at least two input audio channels, the second extracted audio channel including second portions of one or more of the plurality of direction parameters, and wherein each second portion is determined based on the second direction of sound to extract and the output angle of the loudspeaker; and remix the extracted audio channel and second extracted audio channel into a spatially enhanced channel.

20. An apparatus comprising:

means for receiving at least two input audio channels having a plurality of direction parameters for regions of the at least two input audio channels;

means for receiving a direction of sound to extract from the at least two input audio channels;

means for determining an output angle of a loudspeaker measured from a median axis of a listening direction; and means for extracting an extracted audio channel for output on the loudspeaker from the at least two input audio channels according to the direction parameters, the extracted audio channel corresponding to the direction of sound to extract, wherein the extracted audio channel includes portions of one or more of the plurality of direction parameters, and wherein each portion is determined based on the direction of sound to extract and the output angle of the loudspeaker.

21. An integrated circuit comprising:

an audio input interface configured to receive at least two input audio channels having a plurality of direction parameters for regions of the at least two input audio channels;

an external control interface configured to receive a direction of sound to extract from the at least two input audio channels; and a synthesizer configured to:

determine an output angle of a loudspeaker measured from a median axis of a listening direction, and extract an extracted audio channel for output on the loudspeaker from the at least two input audio channels according to the direction parameters, the extracted audio channel corresponding to the direction of sound to extract, wherein the extracted audio channel includes portions of one or more of the plurality of direction parameters, and wherein each portion is determined based on the direction of sound to extract and the output angle of the loudspeaker.

* * * * *